US005503487A

United States Patent [19]

Ong

[11] Patent Number: 5,503,487

[45] Date of Patent: Apr. 2, 1996

[54] CUSTOM INDEX TABS

[76] Inventor: Bon S. Ong, P.O. Box 4247, Torrance, Calif. 90510

[21] Appl. No.: 303,659

[22] Filed: Sep. 9, 1994

[51] Int. Cl.[6] ..... B42F 21/08; B42F 21/10

[52] U.S. Cl. ..... 402/79; 281/38; 283/36; 283/37; 40/359

[58] Field of Search ..... 402/79, 80 R; 281/38; 283/36–43; 40/359

[56] References Cited

U.S. PATENT DOCUMENTS

| | | | |
|---|---|---|---|
| 2,260,407 | 10/1941 | Schade | 40/359 |
| 2,878,814 | 3/1959 | Consaul | 40/359 |
| 4,053,057 | 10/1977 | Snowden | 40/359 X |
| 4,400,107 | 8/1983 | Pitts | 402/80 R X |
| 4,660,855 | 4/1987 | Pagliaccio | 2/500 X |
| 4,784,508 | 11/1988 | Shannon | 402/80 R X |
| 5,066,045 | 11/1991 | Hawes, Jr. et al. | 40/359 X |
| 5,311,685 | 5/1994 | Wyant | 40/359 |

*Primary Examiner*—Frances Han
*Attorney, Agent, or Firm*—Charles H. Thomas

[57] ABSTRACT

A separator page is provided for a set of papers of uniform size and shape. The separator page preferably has the same rectangular size and shape as each of the papers in the set of papers. At an unbound edge the separator page has a plurality of parallel, uniformly space slots of uniform length. These slots are spaced a uniform distance from the selected unbound edge. An index tab has a labeling portion wider than the distance between the slots and the edge along which the slots are aligned. A pair of insertion ears extend in opposite directions from the labeling portion of each index tab. Each of the ears is of such a width as to fit snugly into the slots. The index tabs are thereby removably and selectively positionable at different locations along the mounting edge with the ears thereof inserted into alternatively selected slots. The labeling portion of the index tab projects outwardly from the selected unbound edge of the set of papers, and is thereby visible in between the papers. Because the longitudinal position of the index tab may be varied to an extent limited only by the number of slots, the separator page of the invention has considerably greater versatility than conventional separator or divider pages that are utilized to delineate different sections within a set of papers.

19 Claims, 3 Drawing Sheets

CUSTOM INDEX TABS

BACKGROUND OF THE INVENTION

1. Field of the Invention

The present invention relates to a system of custom index tabs to provide a user with greater versatility in separating a stack of documents to be bound together into different sections utilizing separator pages with index tabs thereon.

2. Description of the Prior Art

At present there are several different systems of index tabs that are typically employed to divide a stack of papers suitable for binding in a three-ring binder or otherwise into different sections. One conventional system employs die cut separator pages which have a main body or base portion of a size and shape substantially identical to the size and shape of papers in the stack, and also outwardly projecting index tabs. Separator pages of this type are typically sold in sets with the index tab on each separator page in the set being formed at a particular longitudinal location along the length of one of the unbound edges of the separator page. This unbound edge is typically the edge opposite the edge at which the papers are to be bound.

Separator pages of this type have a considerable disadvantage due to the permanent position of the index tabs thereon. That is, the position of each index tab longitudinally along the edge of each separator page within a set is fixed and cannot be altered.

Very typically users of separator pages of this type greatly prefer for the index tabs projecting from the separator pages to commence in an ordered sequence beginning at one end of a tabbed edge and progressively advancing with incremental offsets toward the opposite end of the tabbed edge. For example, a set of papers is often divided into sections and carried in a conventional three-ring binder. The papers are therefore punched with three holes spaced along the left-hand edge. Very typically separator pages are provided with index tabs projecting outwardly therefrom along their common opposite, right-hand edges.

For a portfolio of the contents of a three-ring binder to have an organized, professional appearance, it is desirable for the index tab of the first separator page, proceeding either from the top or from the bottom of the stack of documents, to reside near the upper right-hand corner at the top of the tabbed edge of the separator pages. The next sequential separator page preferably has an index tab located a spaced distance further down the tabbed edge. The next sequential separator page preferably has an index tab offset from the first two an even greater distance from the top along the tabbed edge. The index tabs proceed in sequentially advanced offset arrangement in this fashion until reaching the separator page in which the index tab is at the lowermost location near the bottom of the tabbed edge. The sequence is then repeated.

The reason for the advancing offset in the index tabs of sequential separator pages is to provide for maximum visibility of all of the index tabs from above the stack of papers. That is, it is highly desirable for the index tabs of the separator pages to advance in such a sequence so that those index tabs near the top of the stack of papers do not cover up and hinder viewing of the index tabs of the separator pages that are located deeper in the stack. The sequence of offset advancement in the location of the index tabs may either commence from the top of the stack of the papers toward the bottom, or from the bottom of the stack of papers toward the top. In either case the longitudinal offset of the tabs on the sequential separator pages minimizes the extent to which the tabs of the separator pages deeper in the stack are obscured by those located thereabove.

One difficulty with the fixed index tab arrangement in conventional separator pages is that sections within a set of papers, such as those carried in a three-ring binder, are frequently inserted, removed, and sometimes rearranged. Different sections are added to update the portfolio to include more current material, and sections are sometimes removed to delete obsolete material. As a consequence, the orderly progressive advancement of the locations of the index tabs along the tabbed edges of the sequential separator pages is frequently disrupted. As a result, the index tabs often tend to obscure each other, and also present an unsightly, disorganized appearance.

A further difficulty with conventional separator pages is the considerable amount of waste that occurs with each separator page set. That is, the separator page in each set in which the index tab is located uppermost near the top of the tabbed edge is utilized in virtually every set of papers to be tabbed. However, depending upon the number of sections into which the set of papers is to be divided, there are inevitably a number of separator pages with index tabs located further down the tabbed edge, that are not used. As a consequence, for each complete set of separator pages that are purchased, only a portion of these separator pages within the set can ever utilized in the manner for which they were designed.

A further difficulty with conventional separator pages is the inflexibility in uniformity of spacing of the index tabs from top to bottom along a tabbed edge. That is, sometimes only a few separator pages are required to divide a set of papers into sections. If the user selects the initial separator pages in sequential order in the sequence in which they are intended to be used, the index tabs thereof are all crowded near the upper portion of the tabbed edge of the set of papers. If a user attempts to space the tabs more uniformly by selecting the separator pages out of sequence the entire sequence of use of the separator pages is disrupted. For example, if a set of papers is to be divided into only three sections, utilizing only three separator pages, the user could select the initial separator page having an index tab near the top of the tabbed edge, a separator page from the middle of the planned sequence having an index tab at the center, and a final separator page in the sequence having an index tab near the bottom of the tabbed edge. While this will accommodate the particular set of documents involved, it disrupts the orderly sequence of the unused separator pages, thus often rendering them unusable for other purposes.

Another type of index tabbing system that is utilized employs index tabs that are initially detached from separator pages, and which can be permanently attached thereto when a set of papers is to be divided into sections. Such index tabs typically employ gummed, moisture sensitive adhesive on the portion of the index tab that is to be affixed to a separator page. This system does allow flexibility in the initial positioning of the separator tabs along the tabbed edges of a set of papers. However, once such index tabs are attached to the separator pages, their locations thereon cannot be altered. Therefore, if different sections are added or removed from a binder at a later time, the orderly progression of the index tabs along the tabbed edges of the separator pages is disrupted, as with separator pages manufactured with index tabs at fixed positions thereon. Also, very frequently the adhesive on such gummed index tabs fails over a period of time, and the tabs fall off.

SUMMARY OF THE INVENTION

It is an object of the present invention to provide a unique system of index tabbing a set of papers which can be customized for each usage. That is, for each set of papers in which separator pages are to be provided with index tabs, the position of each index tab along the length of the tabbed edge can be chosen for optimum visibility, accessibility, and aesthetic appearance.

A further object of the invention is to provide an index tabbing system which can be altered even after initial tab positions have been chosen. As a consequence, when sections of a set of papers are added or removed, the positions of the tabs along the edges of the separator pages can be altered to accommodate these changes. The index tabbing system thereby provides for customized indexing not only initially, but throughout any number of revisions in the content of a set of documents.

A further object of the invention is to provide a customized index tabbing system which does not require a permanent adhesive for immovably positioning of the index tabs along a tabbed edge of a set of documents. Rather, the index tabs according to the invention are removably attachable to separator pages at different locations along the tabbed edges thereof. Furthermore, the spacing along the tabbed edges of a set of separator pages can likewise be altered as desired by the user. For example, if only a few separator pages are to be employed, the index tabs utilized in the invention can be widely spaced apart in the sequentially positioned separator pages so as to afford a maximum longitudinal separation therebetween. This maximizes visibility, and accessibility and enhances the aesthetic appearance of the tabs in a set of documents. Also, unlike prior systems, there are no unused index tabs which will go to waste if only a few index tabs are required for a particular set of papers. On the other hand, where a set of documents is to be divided into a great number of sections, the index tabs can be longitudinally offset only slightly from one separator page to the next so as to allow a greater number of index tabs to be employed in a progression of offset increments from one extremity of the tabbed edge to the other.

In one broad aspect the present invention may be considered to be a combination of a set of flat papers, a separator page, and an index tab. The flat papers in the set are of a uniform size and shape. The papers have a common binding edge and a plurality of unbound edges. The separator page preferably has the same size and shape as the papers and also has a binding edge and a plurality of unbound edges as well in common with the papers.

The separator page is formed with a plurality of mutually parallel slots of equal length located at uniform intervals along a selected one of the unbound edges and at a uniform distance of separation therefrom. The index tab is formed with a labeling portion having a width greater than the uniform distance of separation of the slots from the selected unbound edge. The index tab has a pair of ears that are narrow enough to fit into the slots. These ears project from the labeling portion. By employing this construction the index tab is removably attachable to the separator page at alternative locations along the selected one of the unbound edges with the ears thereof inserted into alternatively selected ones of the slots. The central labeling portion projects outwardly from the set of papers beyond the selected unbound edge of the separator page.

In another broad aspect the invention may be considered to be, in combination, a plurality of flat papers, a separator page, and an index tab. The flat papers are of a uniform size and shape and are arranged in sequence for disposition one atop another. Each paper has one binding edge and a plurality of unbound edges. The separator page is located among the flat papers and is coextensive therewith. The separator page likewise has a binding edge and a plurality of unbound edges in common with the papers. The separator page also has an index tab mounting margin proximate to and spaced from a selected one of the unbound separator page edges. The index tab mounting margin includes a plurality of mutually parallel slots of equal length spaced uniformly from each other along the index tab mounting margin and terminating at a uniform distance of separation from the selected unbound edge. The index tab has a central labeling portion with a width greater than the uniform distance of separation of the slots from the selected unbound edge. The index tab has a pair of ears projecting in opposite directions from the central labeling portion. In a combination of this construction the index tab is removably mountable on the separator page at alternative locations along the index tab mounting margin. The ears of the index tab are inserted into selected ones of the slots. The central labeling portion of the index tab extends outwardly beyond the selected unbound edge of the separator page.

In still another broad aspect the invention may be considered to be an improvement in a set of flat papers of uniform size and shape, each of which has a binding edge and a plurality of unbound edges. The improvement of the invention is comprised of a separator page of same size and shape as each of the papers. The separator page likewise has a bound edge and a plurality of unbound edges. The separator page defines thereon a plurality of uniformly space slots of uniform length located proximate to a selected one of the unbound edges and spaced at a uniform distance therefrom. The index tab has a labeling portion wider than the uniform distance of separation of the slots from the selected unbound edge. The index tab also has a pair of insertion ears extending in opposite directions from the labeling portion. Each of the ears is of such a width as to pass snugly into the slots. The index tabs are thereby removably and selectively positionable at different locations along the selected unbound edge with the ears thereof inserted into alternatively selected ones of the slots. The labeling portion of the index tab protrudes outwardly from the selected unbound edge.

The separator page of the invention in which the slots are located may either be formed from a single sheet of flat, flexible material, such as paper, card stock, or plastic, or as a composite structure. In those embodiments in which the separator page is formed of a single sheet of flat, flexible material, this sheet may be of a rectangular shape of exactly the same size and shape as the papers in the set of papers. In this embodiment the slots may be defined in a column extending through the thickness of the flexible sheet at uniformly spaced intervals and at a uniform distance from one of the unbound edges of the separator sheet. Typically this edge lies opposite the edge at which the separator sheet and papers are to be bound.

Alternatively the separator page may be formed of a sheet of flat, flexible material that is initially wider than the papers to be separated. The edge of the sheet remote from the binding edge is then doubled back at a fold demarcation. The fold demarcation divides the separator page into a broad, expansive base portion and a marginal strip portion of uniform width throughout. The marginal strip portion is doubled back at the fold demarcation so as to overlie an adjacent area of the base portion. The marginal strip portion is secured to the adjacent area of the base portion, typically by adhesive. The fold demarcation thereupon forms the selected unbound edge of the separator page at which the tabs appear.

The plurality of slots are defined in the marginal strip portion of the separator page. In this embodiment the ears of the index tab are inserted through two of the slots in the marginal strip portion. The ears thereupon reside between the structure of the marginal strip portion and the adjacent area of the base portion, while the central labeling portion of the index tab extends laterally outwardly beyond the tab edge of the separator page.

In still other embodiments the slots are formed in a marginal band that is originally a structure separate from the flat, flexible material forming the base portion of the separator page. This marginal band may be made of paper, plastic, or some other material, and is preferably a material stiffer than the flat, flexible material forming the base portion of the separator page. The marginal strip may have a variety of different configurations for attachment to the base portion of the separator page, but preferably is secured thereto by adhesive along laterally separated borders that extend lengthwise along the marginal strip. The marginal strip thereby defines an elongated central region or panel free of adhesive within which the slots are formed.

The invention may be described with greater clarity and particularity by reference to the accompanying drawings.

DESCRIPTION OF THE EMBODIMENT

Figure 10:
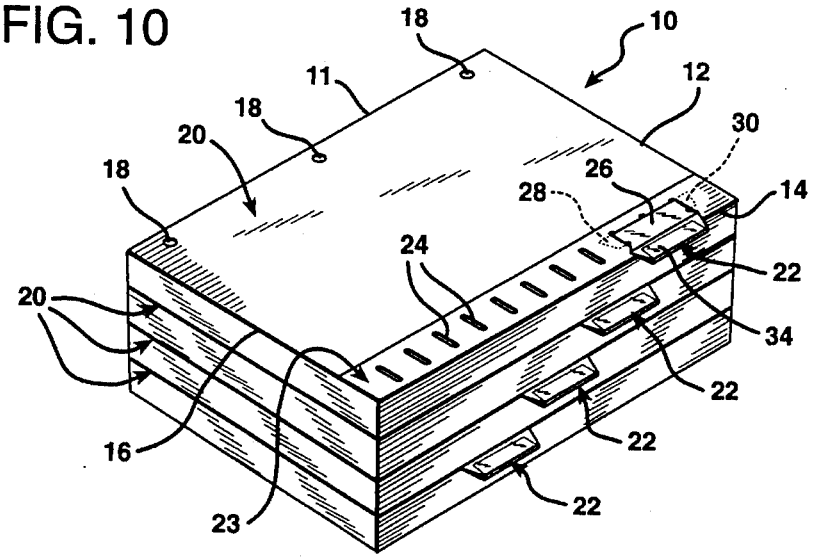
FIG. 10 is a perspective view of a combination of a set of papers, separator pages, and index tabs according to the invention.

FIG. 10 illustrates a set of papers indicated generally at 10. Each of the papers within the set of papers 10 may be of a rectangular shape and may be eight and one-half inches wide and eleven inches in length. Each of the papers has a binding edge 11 and three unbound edges 12, 14, and 16. Each of the papers in the set 10 is perforated by three spaced perforations 18 located a uniform distance from the binding edge 11. The perforations 18 are preferably each about one-quarter of an inch in diameter and are each spaced interiorly from the binding edge 11 a distance of about three-eighths of an inch. The perforations 18 are preferably spaced four and one-quarter inches apart along the binding edge 11. With this size and configuration, the papers in the set of papers 10 can be conveniently bound in a conventional three-ring loose-leaf binder of the type that is widely commercially available from office supply distributors.

Figure 1:
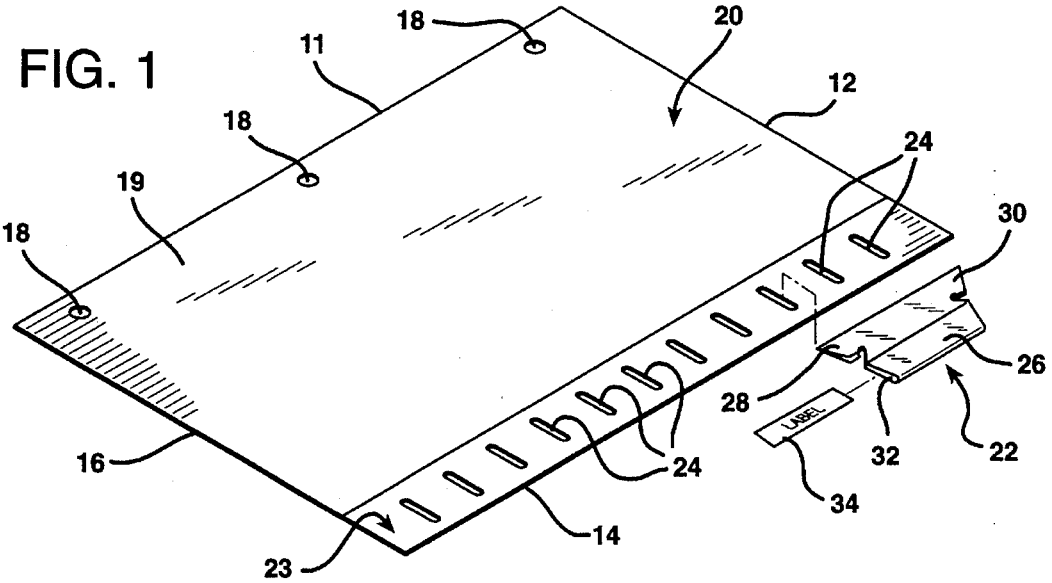
FIG. 1 is an exploded perspective view of one preferred embodiment of a separator page and index tab according to the invention.

The improvement of the invention resides in the provision of a separator page 20 and an index tab 22, such as those illustrated together in FIG. 1. Like each of the pages of the set of papers 10, the separator page 20 has a binding edge 11 and three unbound edges 12, 14, and 16. The binding edge 11 is the lengthwise edge at the left of the separator page 20, while the unbound edges 12 and 16 extend, respectively, across the top and bottom of the separator page 20. The edge 14 is the other lengthwise edge of the separator page 20 that lies parallel to and opposite the binding edge 11.

The separator page 20 has a broad expansive portion 19 that is equal in size and shape to each paper in the stack 10 and a mounting margin 23. The mounting margin 23 of the separator page 20 defines thereon a plurality of parallel, uniformly spaced slots 24 which are of uniform length and which are located proximate to the unbound edge 14 opposite the binding edge 11. The slots 24 are spaced a uniform distance from the edge 14. The slots 24 preferably terminate about five-sixteenths of an inch from the edge 14 and are each about one-half of an inch in length. The slots 24 are spaced a uniform distance apart, preferably about one inch from each other. Spacings of one half inch, one quarter inch, and other spacings may be desirable for some applications.

In the embodiment of FIG. 1 the separator page 20 is comprised of a marginal, narrow, rectangular paper or cardstock strip disposed along an outer edge 14 of the underlying sheet of material 19 forming a base portion. This strip forms the mounting margin 23. This marginal strip 23 is of uniform width throughout and surmounts the sheet of material 19. The sheet of material 19 forms the binding edge 11 and all of the unbound edges 12, 14, and 16. The marginal strip 23 is located adjacent the selected unbound edge 14 of the underlying sheet of material 19. The marginal strip 23 extends the entire length of the unbound edge 14 and is secured to the underlying flat, expansive sheet of material 19 by adhesive on its underside.

The index tab 22 has a labeling portion 26 that is wider in transverse width than the distance of the slots 24 from the unbound edge 14. Preferably, the labeling portion 26 of the index tab 22 is about one and three-sixteenths inches in width. The index tab 22 has a pair of insertion ears 28 and 30 that extend in opposite directions from the labeling portion 26. Each of the insertion ears 28 and 30 is of such a width as to pass snugly into the slots 24. That is, each of the insertion ears 28 and 30 is less than one-half of an inch in width. Preferably, the insertion ears 28 and 30, in the embodiment of FIG. 1, each have a maximum width of about fifteen thirty-seconds of an inch.

The index tabs 22 may be of the conventional type utilized for labeling hanging file folders. In the embodiment of FIG. 1 the index tab 22 is formed of either a clear or colored stiff plastic transparent envelope formed of a single die-cut sheet of plastic. The cut sheet is folded in half to form a label pocket 32 therewithin. A paper label 34 with printed indicia thereon is removably inserted into the envelope formed by the folded plastic sheet so as to reside in the pocket 32 defined therewithin. If the envelope formed by the folded plastic sheet of the index tab 22 is a clear plastic structure, the labels 34 may be printed on paper of different colors to provide an identifying indicia for different sections of the set of papers 10.

A separator page 20 with an index tab 22 as described has considerable versatility in use. The index tab 22 is removably mountable on the separator page 20 at alternative locations along the index tab mounting margin 23. The ears 28 and 30 of the index tab 22 are inserted into selected ones of the slots 24 with the central labeling portion 26 of the index tab 22 extending outwardly beyond the selected unbound edge 14 of the separator page 20. For example, the ear 28 of the index tab 22 may be inserted into the third slot 24 from the top edge 12 of the separator page 20, as indicated in FIG. 1.

The clear, transparent plastic structure forming the index tab envelope is stiffer than the sheet of material 19 forming the base portion of the separator page 20. However, the plastic sheet forming the index tab envelope is flexible enough so that the central labeling portion 26 can be elastically distended to allow the other ear 30 to be inserted into the uppermost slot 24 most closely adjacent to the top edge 12 of the separator page 20. When the index tab 22 is released, it will again assume its normally flat shape, with the ears 28 and 30 projecting through the third and first slots 24, respectively, from the top edge 12 of the separator page 20. With this positioning the index tab 22 will be located at the uppermost possible position along the edge 14 of the separator page 20.

As is evident, the index tab 22 can be positioned anywhere along the length of the outer margin 23 of the separator page 20. That is, the index tab 22 could be positioned with the ears 28 and 30 inserted respectively in the fourth and second slots from the top edge 12. Alternatively, the index tab 22 can be positioned with the ears 28 and 30 thereof respectively positioned in the lowermost and third slots 24 from the bottom edge 16 of the separator page 20. In this manner the index tab 22 can be positioned at any selected intermediate location between the top and bottom edges 12 and 16 along the unbound edge 14. The ears 28 and 30 are inserted into appropriately located slots 24 for the longitudinal position along the tabbed edge of the separator page 20 which the index tab 22 is to occupy.

In the embodiment of FIG. 1 the separator page 20 is comprised of a single sheet of a flat, flexible material 19 forming a broad, expansive base portion. This base portion is of a rectangular configuration having dimensions of eight and one-half inches by eleven inches. Preferably, the base portion of the separator page 20 is formed of a slightly heavier or stiffer material than the sheets of paper forming the different pages of the set of papers 10.

Figure 2:
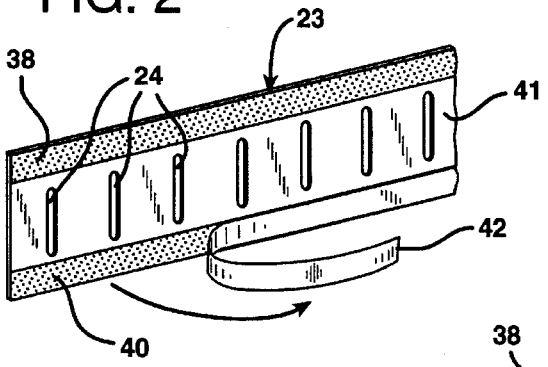
FIG. 2 is a perspective view showing a portion of a marginal strip employed in conjunction with the separator page according to the invention that is depicted in FIG. 1.
Figure 3:
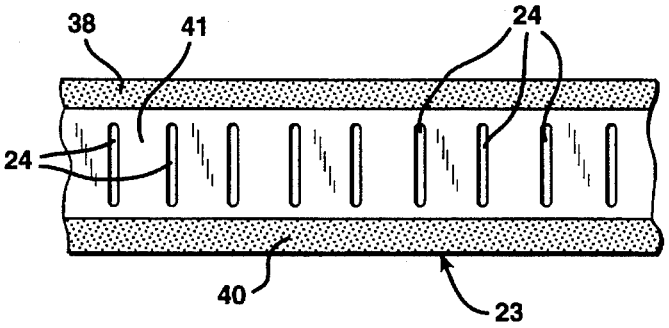
FIG. 3 is a plan view of a portion of the marginal strip of FIG. 2.

FIGS. 2 and 3 illustrate the nature of the marginal strip 23 in greater detail. In the embodiment of FIGS. 1–3 the marginal strip 23 may be formed of the same material as the underlying sheet of material 19 or it may be formed of plastic or paper or cardstock that is stiffer than the material 19 forming the underlying base sheet. For example, the marginal strip 23 may be formed of acetate or Mylar. The marginal strip 23 has a pair of narrow, longitudinally extending fastening regions 38 and 40 that extend the length of the marginal strip 23. These linearly extending regions are covered with pressure sensitive adhesive.

Since the adhesive extends only along the very narrow boundary regions 38 and 40 of the marginal strip 23, the central area of the marginal strip 23 between the longitudinally extending regions 38 and 40 and on the underside of the marginal strip 23 is devoid of adhesive. This allows the ears 28 and 30 of the index tab 22 to be inserted into and removed from different ones of the slots 24 at will.

The slots 24 are defined through the structure of the marginal strip 23 which forms the central panel 41 that lies between the narrow, adhesive-covered, longitudinally extending fastening regions 38 and 40. The marginal strip 23 thereby defines an elongated, central panel 41 located between elongated, laterally-separated borders 38 and 40 on either side. The borders 38 and 40 are secured to the flat, flexible sheet of material 19 throughout their lengths by the adhesive layers on the underside of the marginal strip 23. When the ears 28 and 30 are inserted into the slots 24, they lie beneath the central region 41 between the linearly extending lines of adhesive.

Originally, the fastening regions 38 and 40 are covered by paper strips 42 coated with a release agent to protect the adhesive prior to use. The paper strips 42 can be readily removed from the adhesive coated regions 38 and 40. FIG. 2 illustrates one of the paper strips 42 in an intermediate state of removal from the region 40 after an identical release coated paper strip has already been removed from the adhesive coated region 38. FIG. 3 illustrates the underside of the marginal strip 23 with the adhesive on both of the narrow adhesive-coated regions 30 and 40 exposed. Once the adhesive on the regions 38 and 40 has been exposed, the marginal strip 23 is positioned atop the flat, flexible expansive sheet 19 along the right-hand edge 14 thereof, and pressed downwardly. The adhesive at the regions 38 and 40 thereby firmly anchors the marginal strip 23 to the sheet of material 19.

In the embodiment of FIGS. 1–3 the area between the central panel 41 of the marginal strip 23 and the underlying base sheet 19 is free of adhesive. The marginal strip 23 thereby has laterally separated borders 38 and 40 that are secured to the flat, expansive sheet 19 throughout their lengths. For this reason the ears 28 and 30 of the index tab 22 can be freely removed and inserted relative to the slots 24. The ears 28 and 30 reside in between the elongated, adhesive coated border regions 38 and 40 of the marginal strip 23.

FIG. 10 illustrates a set 10 of flat papers of uniform size and shape arranged in sequence one atop another. As illustrated, a plurality of different separator pages 20 are located among the flat papers and are coextensive therewith. Each of the separator pages 20 has a binding edge 11 and an opposite, selected unbound edge 14 with an index tab mounting margin strip 23 at the unbound edge 14. Each of the separator pages 20 includes a plurality of mutually parallel slots 24. As shown in FIG. 10, the index tabs 22 of each of the different separator pages 20 is positioned in an offset manner from the other index tabs 22. The ears 28 and 30 of the respective index tabs 22 are offset from each other in the series of slots 24 extending down the marginal strips 23. That is, the uppermost index tab 22 illustrated in .FIG. 10 has an ear 28 inserted in the third slot 24 from the upper edge 12 while the ear 30 thereof is inserted into the uppermost slot 24 most closely adjacent to the upper edge 12.

A number of papers are then interposed between the uppermost separator page 20 and the second separator page 20 proceeding vertically downwardly in the stack illustrated in FIG. 10. The index tab 22 of this second separator page 20 down in the stack 10 is longitudinally offset from the uppermost index tab 22 along the unbound edge 14 thereof. That is, the index tab 22 of the second separator page from the top has ears 28 and 30 inserted into the fifth and third slots 24 from the uppermost edge 12 of the second separator page 20, respectively. The third separator page 20 from the top of the stack of papers in the set 10 has ears 28 and 30 inserted into the seventh and fifth slots 24 from the upper edge 12 of the separator page 20. Finally, the index tab 22 of the lowermost separator page 20 in the set of papers 10 has ears 28 and 30 inserted into the ninth and seventh slots 24, respectively, as measured from the upper edge 12 of the separator page 20.

Figure 4:
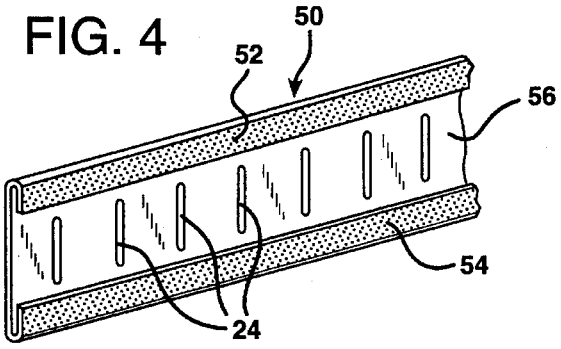
FIG. 4 is a perspective view of another alternative embodiment of a marginal strip according to the invention.

FIGS. 1–3 of the drawings illustrate an embodiment of the invention in which the marginal strip 23 is formed as a flat layer of planar material disposed atop the underlying base sheet of material 19. FIG. 4 illustrates an alternative embodiment of the invention which may also be formed of acetate, Mylar, or some other plastic material. As shown in FIG. 4, the marginal strip 50 is formed as a longitudinally extending band with laterally separated, longitudinally extending borders 52 and 54. Both of the borders and 52 and 54 are doubled under a central panel 56 to form the fastening regions of the marginal strip 50. The central region 56 is located between the borders 52 and 54. The slots 24 are defined through the structure of the central region 56 in between the narrow side borders 52 and 54.

Since the borders 52 and 54 are doubled over and reside beneath the edges of the central region 56, the marginal strip 50 has a generally "C-shaped" configuration, The border regions 52 and 54 are coated with pressure sensitive adhesive and are secured to the underlying sheet of material 19 along the unbound edge 14 thereof. Because of the C-shaped configuration of the marginal strip 50, the central panel 56 is elevated slightly relative to the underlying sheet of material 19. This creates a greater gap or cavity between the marginal area of the underlying sheet 19 near the outer, unbound edge 14 thereof, and the central panel 56 of the marginal strip 50 located immediately thereabove. By raising the central panel 56 out of contact with the underlying sheet of material 19 there is less difficulty in inserting and removing the ears 28 and 30 of the index tab 22. This provides an advantage in repositioning the index tab 22 along the unbound edge 14 of the separator page 20. On the other hand, by elevating the central panel 56 of the marginal strip 50 relative to the underlying sheet 19, the overall thickness of the set of papers 10 will be increased adjacent the unbound edges 14 thereof.

Figure 5:
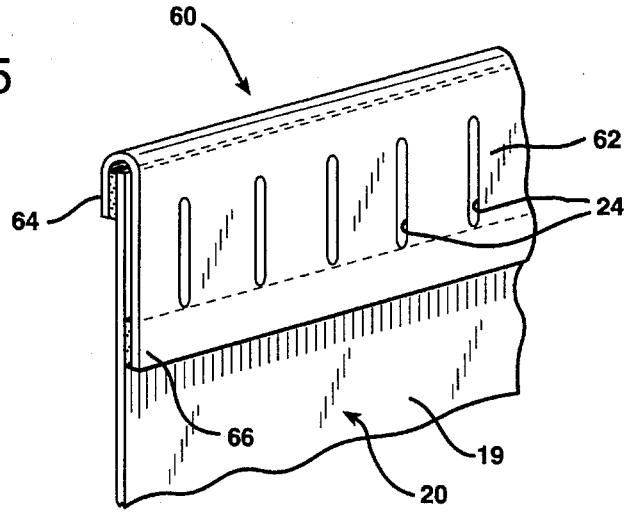
FIG. 5 is a perspective detail showing another alternative embodiment of a marginal strip in a separator page according to the invention.

FIG. 5 illustrated another embodiment of a marginal plastic strip 60 that may be used in conjunction with the underlying base sheet 19. The marginal strip 60 is formed as a longitudinally extending band 62 with lateral borders 64 and 66 forming the narrow, elongated fastening regions. The border 64 is wrapped over the unbound edge 14 of the sheet of material 19 so as to capture it therewithin, as illustrated FIG. 5. The marginal strip 60 thereby has a "J-shaped" cross-sectional configuration. The marginal strip 60 has an advantage in that the wrapped border 64 serves to protect the edge 14 of the underlying base sheet 19. As in the other embodiments, the ears 28 and 30 of the index tab 22 are insertable into and removable from the different slots 24 defined in the central panel 62.

Figure 6:
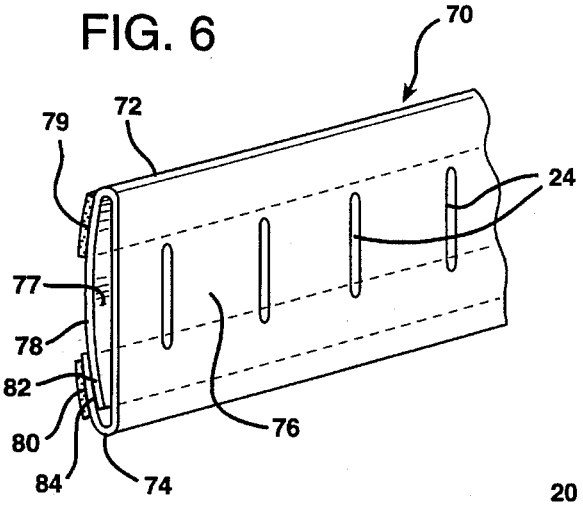
FIG. 6 is a perspective view showing still another alternative embodiment of a marginal strip for a separator page according to the invention.

FIG. 6 illustrates a marginal strip 70 having still another configuration. The marginal plastic strip 70 is formed as a longitudinally extending band folded with two longitudinally extending parallel creases 72 and 74. The marginal strip 70 is folded along the creases 72 and 74 so as to form an elongated first central panel 76 in which the slots 24 are defined, an elongated second backing panel 78 having an inner surface 77 facing the central panel 76 and an elongated retaining flap 80 having an inner surface 82 that also faces the central panel 76 and an opposite surface 84. The backing panel 78 is folded under the central panel 76 and the retaining flap 80 is likewise folded under the central panel 76 to capture a portion of the backing panel 78 therebetween. The laterally separated, longitudinally extending borders or fastening regions are defined on the opposite sides 79 and 84 of the backing panel 78 and the retaining flap 80, respectively. As with the embodiments of FIGS. 2–5, the border regions of the marginal strip 70 are covered with a pressure sensitive adhesive. When these border regions are pressed against the underlying base sheet 19, the marginal strip 70 forms a means for removably mounting the index tabs 22 on the underlying sheet 19.

Figure 7:
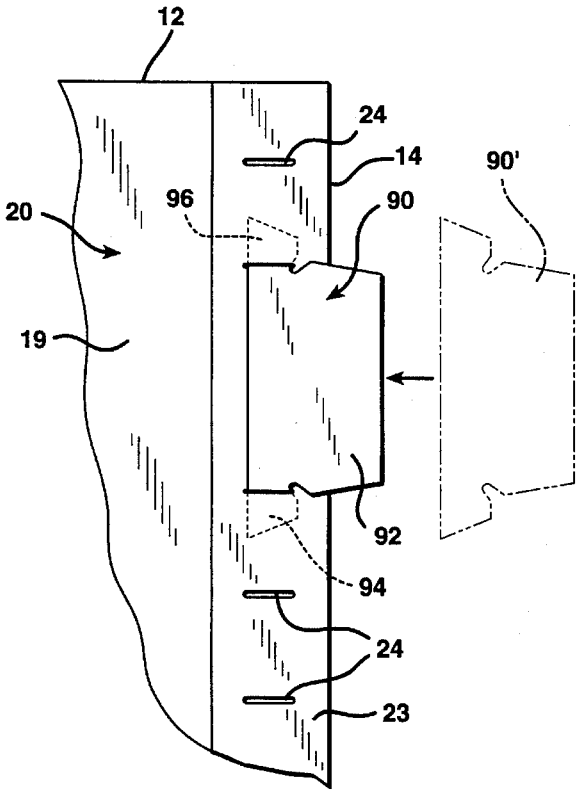
FIG. 7 is a top plan detail showing another alternative embodiment of a separator page and index tab according to the invention.

FIG. 7 illustrates an alternative embodiment of an index tab 90 according to the invention. The index tab 90 shown in FIG. 7 is formed as a flat, single ply unfolded structure stiffer than the separator page 20. The index tab 90 may be cut from stiff card stock, for example. In plan view the configurations of the central region 92 and the ears 94 and 96 of the index tab 90 are identical to the corresponding plan view configurations of the central region 26 and ears 28 and 30 of the index tab 22. The index tab 90 is initially detached from the sheet 19 as indicated at 90'. The index tab 90 may be inserted into selected slots 24 as illustrated, and is also readily removable therefrom.

The primary difference between the index tab 90 and the index tab 22 is that the index tab 90 is comprised of but a single layer of stiff material. Also, in the embodiment of FIG. 7 there is no label to be inserted into the index tab 90. Rather, an indicia of a section of the set of papers 10 is created by writing or printing directly on the central labeling portion 92 of the index tab 90. Alternatively, a plurality of index tabs 92 may be provided in different colors so that the color of the tabs 92 serves as an identifying indicia for a section within the set of papers 10. Both the index tabs 22 and the index tabs 90 are of the type conventionally utilized for labeling hanging file folders.

Figure 8:
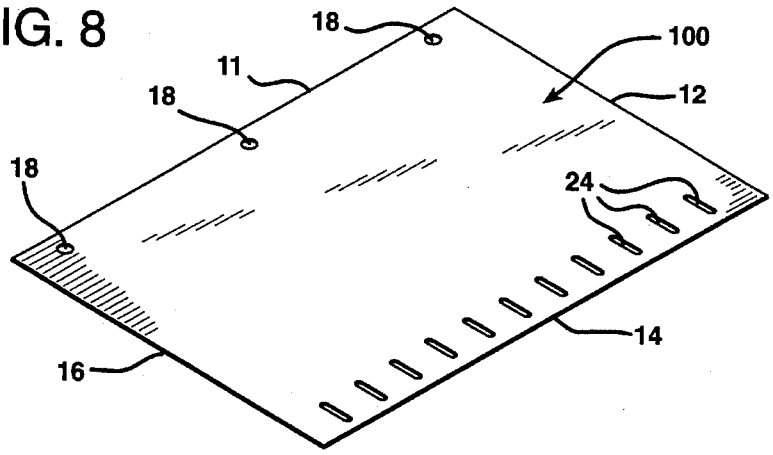
FIG. 8 illustrates still another embodiment of a separator page according to the invention.
Figure 9:
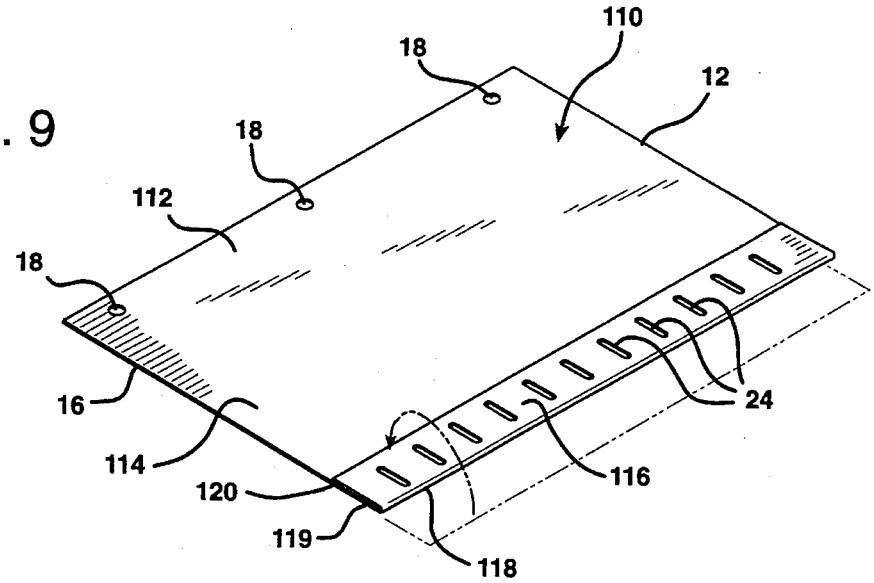
FIG. 9 shows still another embodiment of an index page according to the invention.

FIGS. 8 and 9 illustrate alternative embodiments of separator pages of somewhat different construction. The separator page 100 shown in FIG. 8 differs from the separator page 20 in that the separator page 100 is formed of only a single sheet of flat, rectangular, flexible material, such as paper. The separator sheet 100 has the same corresponding binding edge 11 and unbound edges 12, 14, and 16 as the separator page 20 and is of the same size as the underlying sheet 19 shown in FIG. 1. The page 100 is also perforated with the three apertures 18 closely adjacent to its binding edge 11. The apertures 18 are of a size and are separated as previously described. Unlike the embodiment of FIGS. 1–3, however, the slots 24 are defined through the entire structure of the separator page 100, rather than just through one of two superimposed layers. The ears 28 and 30 of the index tab 22 will thereby reside on the underside of the single flat sheet of paper forming the separator page 100, while the central labeling portion 26 thereof is located on the top side of the same sheet.

FIG. 9 illustrates a further embodiment of a separator page according to the invention. The separator page 110 depicted in FIG. 9 is comprised of a single sheet of flat, flexible material 112. The sheet 112 is formed into a rectangular configuration, but is initially wider than the sheet forming the separator page 100. The sheet 112 includes a broad, expansive base portion 114, but also has a marginal strip 116. The marginal strip 116 is of a uniform width throughout and is doubled back at a fold demarcation 118 so as to overlie an adjacent area 119 of the base portion 114 of the sheet 112. The marginal strip portion 116 of the sheet 112 is secured to the adjacent area of the base portion 114 by a linear bead of adhesive located near the outer edge extremity of the marginal strip portion 116. This linear bead of adhesive is indicated at 120 and extends throughout the length of the marginal strip portion 116 to adhesively hold the underside thereof against the adjacent area 119 of the underlying base portion 114. The bead of adhesive 120 is continuous and extends between the lower edge 16 and the upper edge 12 of the sheet 112.

In the embodiment of FIG. 9, the fold demarcation 118 forms the unbound edge of the separator page 110 at which the slots 24 are located. The slots 24 are defined in the marginal strip portion 116 of the separator page 110 with the slot length, interval of slot spacing, and spacing of the slots 24 from the unbound edge 118 the same as previously described. With these slot lengths and spacings the slots 24 will readily receive both the index tabs 22 and the index tabs 90 that are conventionally utilized with hanging files.

Undoubtedly, numerous variations and modifications of the invention will become readily apparent to those familiar with office supply products. For example, the marginal strip at which the index tabs appear need not necessarily run along the right-hand side of the separator pages, but could be mounted to extend adjacent and parallel to either the top unbound edge 12 or the bottom unbound edge 16 of each separator page 20. Also, where marginal strip portions of multiple plies are employed, as in the embodiments of FIGS. 1–7 and 9, staples or interlocking edge tabs could be utilized in place of adhesive to hold the marginal strips in position adjacent the selected unbound separator page edge.

Accordingly, the scope of the invention should not be construed as limited to the specific embodiments illustrated and described.

I claim:

1. In combination, a set of flat papers of uniform size and shape having a common binding edge and a plurality of unbound edges, the improvement comprising a separator page having a binding edge and a plurality of unbound edges in common with said papers and formed with a plurality of mutually parallel slots of equal lengths located at uniform intervals along a selected one of said unbound edges at a uniform distance of separation therefrom, and an index tab formed with a labeling portion and having a width greater than said uniform distance of separation and a pair of ears narrow enough to fit into said slots projecting from said labeling portion, whereby said index tab is removably attachable to said separator page at alternative locations along said selected one of said unbound edges with said ears thereof inserted into alternatively selected ones of said slots and with said labeling portion projecting outwardly from said set of papers beyond said selected unbound edge of said separator page.

2. A combination according to claim 1 further characterized in that said separator page is comprised of a single sheet of flat, flexible material and is of a uniform thickness throughout.

3. A combination according to claim 1 further characterized in that said separator page is comprised of a single sheet of flat, flexible material having a broad expansive base portion and having a marginal strip portion of uniform width throughout doubled back at a fold demarcation so as to overlie an adjacent area of said base portion and wherein said marginal strip is secured to said adjacent area of said base portion and said fold demarcation forms said selected unbound edge of said separator page and wherein said plurality of slots are defined in said marginal strip portion of said separator page.

4. A combination according to claim 1 further characterized in that said separator page is comprised of a flat, flexible sheet of material forming said binding edge and said unbound edges and a marginal strip of uniform width throughout surmounting said sheet of material adjacent said selected unbound edge thereof throughout the entire length thereof and said marginal strip is secured to said sheet of material and said plurality of slots are defined in said marginal strip.

5. A combination according to claim 4 wherein said marginal strip has a pair of narrow, longitudinally extending fastening regions extending the length thereof and between which said slots are defined, and said marginal strip is secured to said sheet of material over the lengths of said fastening regions.

6. A combination according to claim 5 wherein said marginal strip is coated with an adhesive throughout said lengths of said fastening regions.

7. A combination according to claim 6 wherein said marginal strip is formed as a flat layer disposed atop said sheet of material.

8. A combination according to claim 6 wherein said marginal strip is formed as a longitudinally extending band with laterally separated, longitudinally extending borders, both of which are doubled under to form said fastening regions and further comprising a central region between said borders through which said plurality of slots are defined.

9. A combination according to claim 6 wherein said marginal strip is formed as a longitudinally extending band with lateral borders forming said fastening regions one of which is wrapped over said selected unbound edge of said sheet of material.

10. A combination according to claim 6 wherein said marginal strip is formed as a longitudinally extending band with two longitudinally extending parallel creases folded to form an elongated first central panel in which said plurality of slots are defined, an elongated second backing panel having an inner surface facing said central panel and an opposite surface, and an elongated retaining flap having a surface facing said central panel and an opposite surface, and said backing panel is folded under said central panel and said retaining flap is folded under said central panel to capture a portion of said backing panel therebetween, and said fastening regions are defined on said backing panel and on said retaining flap.

11. A combination according to claim 4 wherein said marginal strip is formed of a material stiffer than said flexible sheet of material.

12. A combination according to claim 1 wherein said index tab is formed as a flat structure and is stiffer than said separator page.

13. A combination according to claim 1 wherein said index tab is comprised of a transparent envelope and a label removably inserted into said envelope.

14. In combination, a plurality of flat papers of uniform size and shape arranged in sequence for disposition one atop another, each paper having one binding edge and a plurality of unbound edges, the improvement comprising a separator page located among said flat papers and coextensive therewith and likewise having a binding edge in common with said binding edges of said papers and a plurality of unbound edges and having an index tab mounting margin at one of said unbound edges and including a plurality of mutually parallel slots of equal length spaced uniformly from each other along said index tab mounting margin and terminating at a uniform distance of separation from said selected unbound edge, and an index tab having a central labeling portion with a width greater than said uniform distance of separation and with a pair of ears projecting in opposite directions from said central labeling portion, whereby said index tab is removably mountable on said separator page at alternative locations along said index tab mounting margin with said ears of said index tab inserted into selected ones of said slots and with said central labeling portion of said index tab extending outwardly beyond said selected unbound edge of said separator page.

15. A combination according to claim 14 further characterized in that said separator page is formed of a flat flexible sheet of material and has a uniform thickness throughout.

16. A combination according to claim 14 further characterized in that said separator page is formed of a flat, flexible sheet of material and has a broad expansive base region of the same size and shape as each of said pages and said mounting margin is formed by an elongated strip of said sheet folded to form said selected unbound edge at a demarcation with said base region and further comprising an adhesive that fastens said strip to said base region along its length.

17. A combination according to claim 14 wherein said separator page is formed of a flat flexible sheet of material and said margin is formed of a band of material stiffer than said flat, flexible sheet of material and which is disposed thereagainst, and said margin has an elongated central panel and elongated laterally separated borders on either side of said central panel and said borders are secured to said flat, flexible sheet of material throughout their lengths by adhesive.

18. In a set of flat papers of uniform size and shape each of which has a binding edge and a plurality of unbound edges the improvement comprising a separator page likewise having a binding edge and a plurality of unbound edges and defining thereon a plurality of parallel uniformly spaced slots of uniform length located proximate to a selected one of said unbound edges and spaced a uniform distance therefrom and an index tab having a labeling portion wider than said uniform distance and a pair of insertion ears extending from said labeling portion, each of said ears being of such a width as to pass snugly into said slots, said index tab thereby being removably and selectively positionable at different locations along said selected unbound edge with said ears thereof inserted into alternatively selected ones of said slots and with said labeling portion thereof protruding outwardly from said selected unbound edge.

19. An improvement according to claim 18 wherein said separator page is comprised of a flat, expansive sheet of flexible material and a marginal band disposed atop said sheet of flexible material and having an elongated central panel in which said slots are formed and elongated, laterally separated borders on opposite sides of said band secured to said flat, expansive sheet throughout their lengths.

* * * * *